US006003267A

United States Patent [19]

Weder

[11] Patent Number: 6,003,267

[45] **Date of Patent: *Dec. 21, 1999**

[54] METHOD FOR PROVIDING A DECORATIVE COVER FOR A FLOWER POT

[75] Inventor: Donald E. Weder, Highland, Ill.

[73] Assignee: Southpac Trust International, Inc., Rarontonga, Cook Islands

[ * ] Notice: This patent is subject to a terminal disclaimer.

[21] Appl. No.: 09/301,066

[22] Filed: Apr. 28, 1999

Related U.S. Application Data

[63] Continuation of application No. 09/047,596, Mar. 25, 1998.

[51] Int. Cl.[6] ..... A01G 9/02; A01B 79/00

[52] U.S. Cl. ..... 47/72; 47/58.1

[58] Field of Search ..... 47/72, 58.1, 84; 53/397, 399, 411, 415, 135.2; D11/143; 206/423, 767, 806; 156/DIG. 12, DIG. 23

[56] References Cited

U.S. PATENT DOCUMENTS

| | | | |
|---|---|---|---|
| D. 405,689 | 2/1999 | Moon | D9/433 |
| 787,178 | 4/1905 | Hopkins . | |
| 931,631 | 8/1909 | Milhado . | |
| 1,520,647 | 12/1924 | Hennegan . | |
| 1,525,015 | 2/1925 | Weeks . | |
| 1,689,155 | 10/1928 | Rittenhouse . | |
| 1,821,564 | 10/1931 | Muller . | |
| 1,890,314 | 12/1932 | Crane . | |
| 1,958,517 | 5/1934 | Low | 40/7 |
| 1,970,370 | 8/1934 | Foser | 47/41 |
| 2,146,173 | 2/1939 | Cooper | 217/124 |
| 2,217,454 | 10/1940 | Pfeiffer | 41/34 |
| 2,303,296 | 11/1942 | Avery | 229/53 |
| 2,340,373 | 2/1944 | Gardner | 47/37 |
| 2,420,045 | 5/1947 | Krug | 40/2 |
| 2,468,695 | 4/1949 | Wallace et al. | 93/2 |
| 2,540,707 | 2/1951 | Beukelman | 229/21 |
| 2,554,013 | 5/1951 | Despres | 220/85 |
| 2,845,735 | 8/1958 | Werner | 41/10 |
| 3,214,075 | 10/1965 | Champlin et al. | 229/16 |
| 3,271,922 | 9/1966 | Wallerstein et al. | 53/3 |
| 3,376,666 | 4/1968 | Leonard | 47/41.01 |
| 3,508,372 | 4/1970 | Wallerstein et al. | 53/3 |
| 3,556,389 | 1/1971 | Gregoire | 229/53 |
| 3,748,781 | 7/1973 | Erling | 47/34.11 |
| 3,821,423 | 6/1974 | Jamin | 426/106 |
| 3,962,503 | 6/1976 | Crawford | 428/40 |
| 3,974,915 | 8/1976 | Mieuli, Jr. | 206/423 |
| 4,089,410 | 5/1978 | Bolanowski et al. | 206/63.3 |
| 4,091,925 | 5/1978 | Griffo et al. | 206/423 |
| 4,101,032 | 7/1978 | Obidniak | 206/457 |

(List continued on next page.)

FOREIGN PATENT DOCUMENTS

| | | | |
|---|---|---|---|
| 511160 | 5/1952 | Belgium | 47/72 |
| 592756 | 4/1994 | European Pat. Off. | 47/72 |
| 542958 | 5/1993 | Japan | 47/72 |
| 560532 | 4/1975 | Switzerland | 47/72 |
| 12250 | 5/1906 | United Kingdom . | |
| 28322 | 12/1907 | United Kingdom | 47/72 |
| 1204647 | 9/1970 | United Kingdom . | |
| 1577949 | 10/1980 | United Kingdom . | |
| 2128083 | 4/1984 | United Kingdom . | |

*Primary Examiner*—Michael J. Carone
*Assistant Examiner*—Fredrick T. French, III
*Attorney, Agent, or Firm*—Dunlap, Codding, & Rogers, P.C.

[57] ABSTRACT

The present invention relates to a method for providing a decorative cover for a flower pot. The method includes the steps of (a) providing a sheet of material having a design indicia bearing portion and an opening adapted to receive a lower portion of a flower pot wherein the opening is offset from a central portion of the sheet of material in a direction generally away from the indicia bearing portion of the sheet of material; (b) disposing a lower portion of a flower pot in the opening in the sheet of material; and (c) forming the sheet of material into a decorative cover about the flower pot such that the indicia bearing portion of the decorative cover extends above the remainder of the decorative cover and thereby enhances the visual aesthetic effect of decorative cover.

37 Claims, 5 Drawing Sheets

U.S. PATENT DOCUMENTS

| | | | |
|---|---|---|---|
| 4,108,350 | 8/1978 | Forbes, Jr. | 229/37 R |
| 4,171,085 | 10/1979 | Doty | 229/1.5 B |
| 4,216,620 | 8/1980 | Weder et al. | 47/72 |
| 4,300,312 | 11/1981 | Weder et al. | 47/72 |
| 4,333,267 | 6/1982 | Witte | 47/84 |
| 4,400,910 | 8/1983 | Koudstaal et al. | 47/84 |
| 4,801,014 | 1/1989 | Meadows | 206/423 |
| 4,989,396 | 2/1991 | Weder et al. | 53/397 |
| 5,007,229 | 4/1991 | Weder et al. | 53/397 |
| 5,007,578 | 4/1991 | Simone | 229/1.5 B |
| 5,105,599 | 4/1992 | Weder | 53/399 |
| 5,106,662 | 4/1992 | Khayat | 428/23 |
| 5,111,637 | 5/1992 | Weder et al. | 53/397 |
| 5,111,638 | 5/1992 | Weder | 53/397 |
| 5,145,062 | 9/1992 | Crispi | 206/233 |
| 5,161,348 | 11/1992 | Weder | 53/399 |
| 5,181,364 | 1/1993 | Weder | 53/397 |
| 5,205,108 | 4/1993 | Weder et al. | 53/397 |
| 5,228,234 | 7/1993 | de Klerk et al. | 47/41.01 |
| 5,235,782 | 8/1993 | Landau | 47/72 |
| 5,239,775 | 8/1993 | Landau | 47/72 |
| 5,245,814 | 9/1993 | Weder | 53/397 |
| 5,293,715 | 3/1994 | Kaz | 47/72 |
| 5,307,605 | 5/1994 | Straeter | 53/397 |
| 5,311,991 | 5/1994 | Weder et al. | 206/423 |
| 5,315,785 | 5/1994 | Avot et al. | 47/72 |
| 5,373,943 | 12/1994 | Weder et al. | 206/423 |
| 5,381,642 | 1/1995 | Weder et al. | 53/399 |
| 5,388,695 | 2/1995 | Gilbert | 206/423 |
| 5,396,992 | 3/1995 | Weder | 206/423 |
| 5,400,905 | 3/1995 | Lapalud et al. | 206/423 |
| 5,408,803 | 4/1995 | Weder et al. | 53/399 |
| 5,428,939 | 7/1995 | Weder et al. | 53/397 |
| 5,443,670 | 8/1995 | Landau | 156/191 |
| 5,467,573 | 11/1995 | Weder et al. | 53/397 |
| 5,501,060 | 3/1996 | Weder et al. | 53/399 |
| 5,522,202 | 6/1996 | Weder et al. | 53/399 |
| 5,526,932 | 6/1996 | Weder | 206/423 |
| 5,544,469 | 8/1996 | Weder et al. | 53/410 |
| 5,557,882 | 9/1996 | Weder | 47/44.01 |
| 5,570,488 | 11/1996 | Weder | 206/423 |
| 5,572,826 | 11/1996 | Weder | 47/41.12 |
| 5,595,048 | 1/1997 | Weder et al. | 53/399 |
| 5,615,774 | 4/1997 | Weder | 206/423 |
| 5,634,558 | 6/1997 | Weder | 206/423 |
| 5,687,502 | 11/1997 | Weder | 47/41.01 |
| 5,715,588 | 2/1998 | Weder et al. | 29/450 |
| 5,781,981 | 7/1998 | Weder et al. | 29/450 |
| 5,809,629 | 9/1998 | Weder | 29/469.5 |
| 5,816,020 | 10/1998 | Weder | 53/397 |
| 5,817,382 | 10/1998 | Cheng | 428/40.1 |
| 5,832,663 | 11/1998 | Weder et al. | 47/72 |
| 5,842,569 | 12/1998 | Weder | 29/469.5 |

METHOD FOR PROVIDING A DECORATIVE COVER FOR A FLOWER POT

CROSS-REFERENCE TO RELATED APPLICATIONS

This application is a continuation of copending application U.S. Ser. No. 09/047,596, filed Mar. 25, 1998, entitled "METHOD FOR PROVIDING A DECORATIVE COVER FOR A FLOWER POT.

STATEMENT REGARDING FEDERALLY SPONSORED RESEARCH OR DEVELOPMENT

Not applicable.

BACKGROUND OF THE INVENTION

1. Field of the Invention

The present invention relates to a decorative cover for containers, and more particularly but not by way of limitation, to a decorative cover for flower pots and to methods for producing such decorative cover wherein the decorative cover contains design indicia to personalize or enhance the visual aesthetic effect of the decorative cover.

BRIEF SUMMARY OF THE INVENTION

The present invention relates generally to a decorative cover for flower pots wherein the decorative cover has design indicia for enhancing the visual effect of the decorative cover and to methods for producing such decorative cover. Broadly, the decorative cover has an indicia bearing portion which extends a distance above the remainder of the decorative cover so as to enhance the visual aesthetic effect of the decorative cover. In one aspect, the present invention relates to methods for producing a flower pot cover having design indicia which includes the steps of: (a) providing a sheet of material having a design indicia bearing portion and an opening adapted to receive a lower portion of a flower pot wherein the opening is offset from a central portion of the sheet of material in a direction generally away from the indicia bearing portion of the sheet of material; (b) disposing a lower portion of a flower pot in the opening in the sheet of material; and (c) forming the sheet of material into a decorative cover about the flower pot such that the indicia bearing portion of the decorative cover extends above the remainder of the decorative cover and thereby enhances the visual aesthetic effect of decorative cover.

An object of the present invention is to provide a decorative cover for a flower pot wherein the decorative cover is provided with an indicia bearing portion for enhancing the visual aesthetic effect of the decorative cover.

Another object of the present invention, while achieving the before stated object, is to provide a method of producing a decorative cover for the flower pot wherein the decorative cover is provided with an indicia bearing portion for enhancing the visual aesthetic effect of the decorative cover.

Other objects, features and advantages of the present invention will be apparent to those skilled in the art from the following detailed description when read in conjunction with the accompanying drawings and appended claims.

DETAILED DESCRIPTION OF THE INVENTION

Definitions

Figure 1:
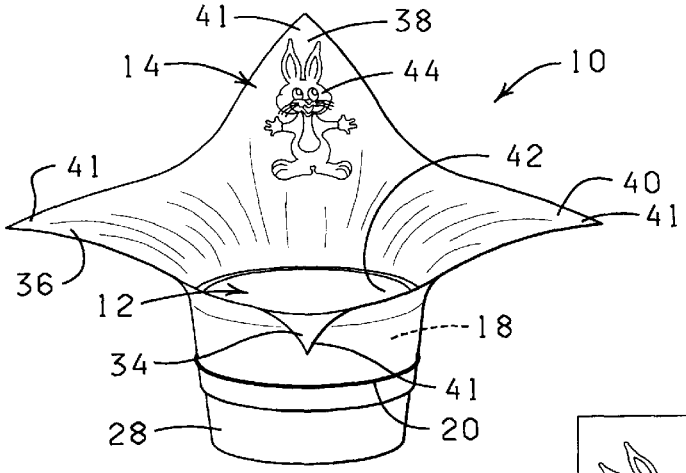
FIG. 1 is a perspective view of a decorative flower pot cover constructed in accordance with the present invention, the decorative flower pot cover having an indicia bearing portion which extends above the remainder of the decorative flower pot cover so as to enhance the visual aesthetic effect of the decorative flower pot cover.

The term "decorative flower pot cover" or "decorative cover" as used herein refers to a cover formed by one or more sheets of material which are disposed about a flower pot.

The term "pot" or "flower pot" as used herein refers to any container or pot-type container which can be used for holding and/or supporting a floral grouping or a potted plant. Examples of pots and flower pots include, but are not limited to, clay pots, wooden pots, plastic pots, pots made from natural and/or synthetic fibers, or combinations thereof.

"Potted plant" as used herein means any living plant which is contained within a flower pot and which is provided with a root portion and a flower portion consisting of blooms and/or foliage.

The term "bonding material" as used herein refers to any adhesive or cohesive including pressure sensitive adhesives and co-adhesives. The term "bonding material" as used herein also refers to materials which are heat sealable, sonic sealable, and/or vibratory sealable. For example, the term "bonding material" can refer to a heat sealing lacquer which may be applied to a sheet of material and effectively bonded thereto by heat, sound waves, or vibrations.

The term "bonding material" as used herein also refers to any type of material or device which can be used to effect the bonding or connecting of two adjacent portions of a sheet of material to effect the connection or bonding described herein. Thus, the term "bonding material" can refer to ties, labels, elastomeric bands, ribbons, strings, tape, staples, and combinations thereof.

The term "bonding material" as used herein also refers to any heat or chemically shrinkable material, electrical bonding means such as static electricity, magnetic bonding means, mechanical or barb-type fastening means, clamping means, curl-type characteristics of a film means, materials incorporated into the sheet of material which can cause the sheet of material to take on certain shapes, and any type of welding methods which may weld portions of the sheet to itself and/or other sheets.

The term "polymer film" as used herein refers to a film formed of synthetic polymers such as polypropylene or naturally occurring polymers such as cellophane, which are relatively strong and not subject to tearing (substantially non-tearable). Various types of "polymer films" are described in U.S. Pat. No. 5,311,991, issued to Weder et al. on May 17, 1994, which is hereby incorporated herein by reference.

The terms "cling wrap" or "cling material" as used herein refer to any material which is capable of connecting a sheet of material to itself when such material is wrapped about an item, such as a flower pot. The terms "cling wrap" or "cling material" are defined in detail in U.S. Pat. No. 5,311,991 issued to Weder et al. on May 17, 1994, which is incorporated herein by reference.

The term "design indicia" as used herein refers to fanciful designs such as hearts, balloons, pumpkins, clover, eggs, tombstones, flowers (such as roses, daisies, lilacs and the like), plants (such as fruits, vegetables, clover, grasses, trees and the like), mammals (such as rabbits, dogs, cats and the like), fictional characters (such as cartoon characters), non-mammals (such as chicks, birds, alligators and the like), or real characters (such as a photograph of an individual), and the like.

Design indicia as used herein also refers to printed information, including letters, numbers, words and/or slogans for special occasions (such as a birthday, an anniversary, a holiday, such as valentine's day, Mother's day, Easter, Christmas and the like), as well as combinations of various fanciful designs and/or printed information, holograms and the like.

DESCRIPTION OF THE VARIOUS EMBODIMENTS

Figure 3:
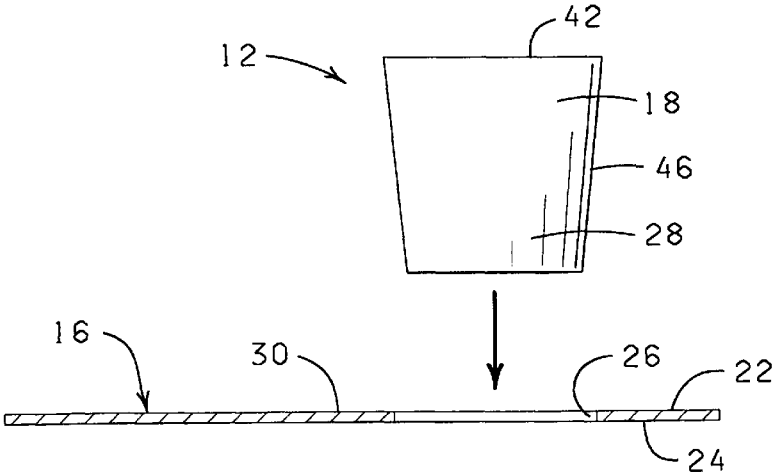
FIG. 3 is a side elevational view, partially in cross section, of the sheet of material of FIG. 2 having a flower pot positioned above the opening in the sheet of material.
Figure 4:
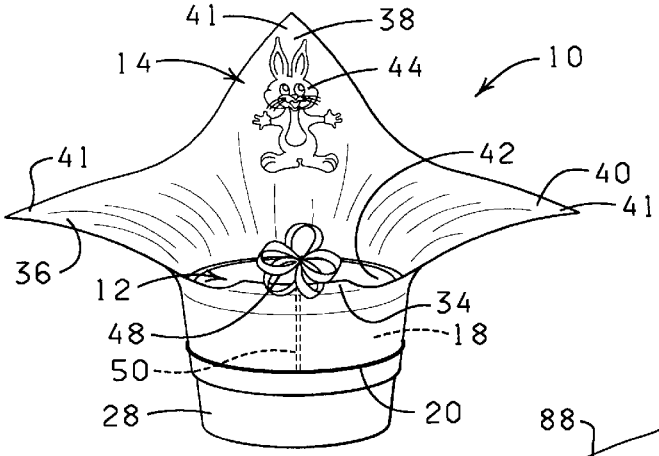
FIG. 4 is a perspective view of the decorative flower pot cover of FIG. 1 wherein a portion of the decorative flower pot cover opposite the indicia bearing portion is folded inwardly into an open upper end of a flower pot.

Referring now to the drawings and more particularly to FIGS. 1 and 4, shown therein is a decorative flower pot cover 10 disposed about a flower pot 12. The decorative flower pot cover 10 is provided with an indicia bearing portion 14 which extends above the remainder of the decorative flower pot cover 10 substantially as shown so as to enhance the visual aesthetic effect of the decorative flower pot cover 10. The decorative flower pot cover 10 is formed by wrapping at least one sheet of material 16 (FIGS. 2 and 3) about an upper portion 18 of the flower pot 12. The decorative flower pot cover 10 is then secured about the upper portion 18 of the flower pot 12 with a suitable bonding material, such as a band 20.

Figure 2:
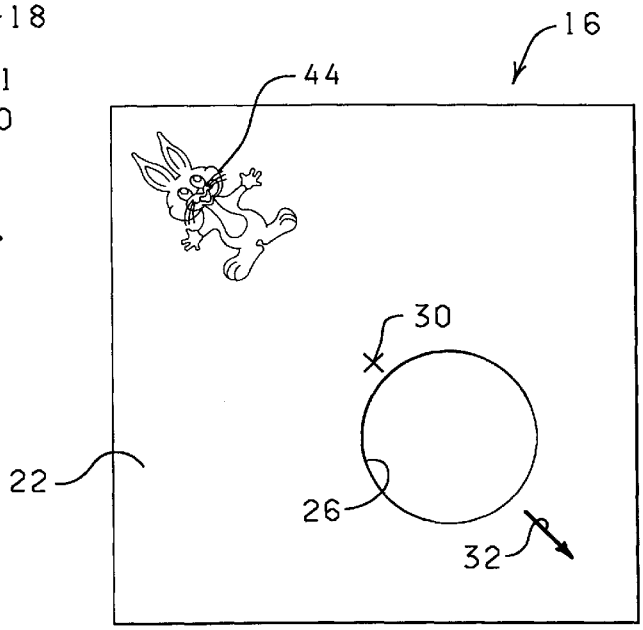
FIG. 2 is a top plan view of a sheet of material having a substantially square-shaped configuration used in the construction of the decorative flower pot cover of FIG. 1, the sheet of material having a design indicia bearing portion and an opening adapted to receive a lower portion of a flower pot wherein the opening is off-set from a central portion of the sheet of material in a direction generally away from the indicia bearing portion of the sheet of material.

As more clearly shown in FIGS. 2 and 3, the sheet of material 16 has, in addition to the design indicia bearing portion 14, an upper surface 22, a lower surface 24, and an opening 26 adapted to receive a lower portion 28 of the flower pot 12. The opening 26 in the sheet of material 16 is offset from a central portion 30 of the sheet of material 16 in a direction 32 generally away from the indicia bearing portion 14 of the sheet of material 16.

The sheet of material 16, which has a substantially square-shaped configuration, is sized so that when the lower portion 28 of the flower pot 12 is disposed in the opening 26 in the sheet of material 16 and the sheet of material 16 is wrapped or formed about the upper portion 18 of the flower pot 12, the decorative flower pot cover 10 so formed is provided with four accentuated flared petal-like portions 34, 36, 38 and 40, each of which terminates with a substantially pointed end 41 formed by the four corners of the substantially square-shaped sheet of material 16. Three of the petal-like portion 34, 36 and 40 extend a distance upwardly and outwardly from an open upper end 42 of the flower pot 12, and the petal-like portion 38, which is formed of the design indicia bearing portion 14 of the sheet of material 16, extends in an upwardly direction from the open upper end 42 of the flower pot 12 substantially as shown and contains a design indicia 44 which enhances the visual aesthetic effect of the decorative flower pot cover 10.

The design indicia 44 may be produced on the sheet of material 16 by application of a dye, ink, and/or pigment to the sheet of material 16 such that, upon forming the sheet of material 16 into the decorative flower pot cover 10, the decorative flower pot cover 10 is provided with the design indicia bearing portion 14. Such dyes, inks, and/or pigments are known in the art and are commercially available, and may be applied to the sheet of material 16 by any method known in the art. In addition, the design indicia 44 may be a hologram and/or an outlined configuration in combination with a printed portion.

Referring more specifically to FIG. 3, the decorative flower pot cover 10 shown in FIGS. 1 and 4 is formed about the flower pot 12 by inserting the lower portion 28 of the flower pot 12 through the opening 26 in the sheet of material 16 such that a portion of the sheet of material 16 adjacent the opening 26 therein frictionally engages a portion of a sidewall 46 of the flower pot 12. The sheet of material 16 is then formed about the upper portion 18 of the flower pot 12 to produce the decorative flower pot cover 10 for the flower pot 12 while maintaining the open upper end 42 of the flower pot 12 substantially uncovered by the decorative flower pot cover 10. To enhance connection of the decorative flower pot cover 10 to the sidewall 46 of the flower pot 12, a bonding material, such as the band 20 (FIGS. 1 and 4) can be positioned about a portion of the decorative flower pot cover 10. In addition, or in the alternative, one can employ an adhesive to bondingly connect the portion of the sheet of material 16 frictionally engaging the sidewall 46 of the flower pot 12 to the flower pot 12, or one can use any other bonding material, such as a tie, a ribbon and the like, to secure the decorative flower pot cover 10 about the upper portion 18 of the flower pot 12.

Referring now specifically to FIG. 4, the petal-like portion 34 of the decorative cover 10 formed from the sheet of material 16 has been folded inwardly into the open upper end 42 of the flower pot 12 so that a decorative item, such as bow 48, or a greeting card or a card containing other information can be secured to a support member 50 which is partially embedded in potting media (not shown) disposed within the flower pot 12.

The sheet of material 16 employed in the construction of the decorative flower pot cover 10 has a substantially planar cross-section and a thickness in a range of from about 0.1 mil to about 30 mils, and more desirably from about 1 mil to about 10 mils. However, it should be understood that the thickness of the sheet of material 16 may vary depending on the type of material from which the sheet of material 16 is constructed. That is, it should be understood that the sheet of material 16 can have any thickness so long as the sheet of material 16 retains sufficient flexibility and foldability so that the sheet of material 16 can be formed about the flower pot 12 to provide the decorative flower pot cover 10 thereabout. For example, the sheet of material 16 can be constructed of paper, metal foil, natural organic polymer films, synthetic organic polymer films, cling wrap, cloth, burlap and/or combinations thereof.

A decorative pattern, such as a color and/or an embossed pattern and/or a hologram and/or other decorative surface ornamentation may be applied to the upper and/or lower surfaces 22 and 24 of the sheet of material 16 or portions thereof, including but not limited to printed designs, coatings, colors, flocking or metallic finishes. Further, the sheet of material 16 may be totally clear or partially clear or a tinted transparent material.

Although the sheet of material 16 has been shown and described herein as having a substantially square-shaped configuration, it should be understood that the sheet of material 16 may assume any geometric, non-geometric, asymmetrical or fanciful shape having any appropriate size so long as the sheet of material 16 can be disposed about the flower pot 12 to form the decorative flower pot cover 10 thereabout. For example, the sheet of material 16 may be rectangular in shape, circular in shape, heart-shaped or the like. 2

Figure 5:
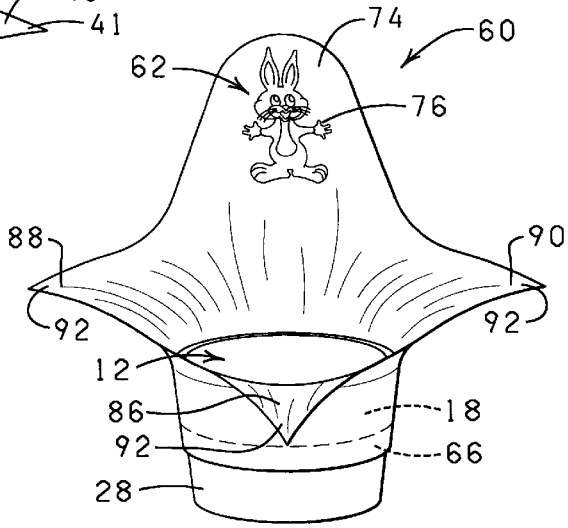
FIG. 5 is a perspective view of another embodiment of a decorative flower pot cover constructed in accordance with the present invention, the decorative flower pot cover having an indicia bearing portion which extends above the remainder of the decorative flower pot cover so as to enhance the visual aesthetic effect of the decorative flower pot cover.

Referring now to FIG. 5, another embodiment of a decorative flower pot cover 60 is shown disposed about the flower pot 12. The decorative flower pot cover 60 is provided with an indicia bearing portion 62 which extends above the remainder of the decorative flower pot cover 60 substantially as shown so as to enhance the visual aesthetic effect of the decorative flower pot cover 60. The decorative flower pot cover 60 is formed by wrapping at least one sheet of material 64 about the upper portion 18 of the flower pot 12 (FIGS. 5 and 7). The decorative flower pot cover 60 is then secured about the upper portion 18 of the flower pot with a suitable bonding material, such as an adhesive material 66 (FIGS. 5 and 6).

Figure 6:
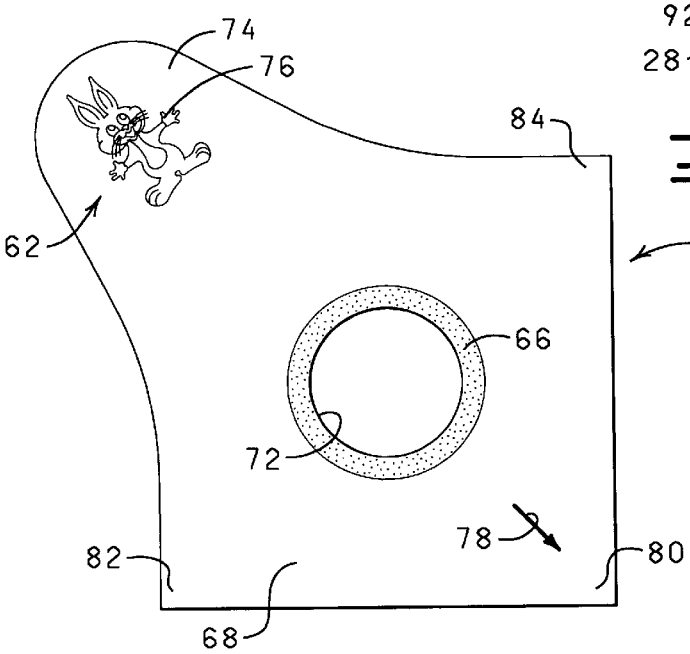
FIG. 6 is a top plan view of a sheet of material used in the construction of the decorative flower pot cover of FIG. 5, the sheet of material having a design indicia bearing portion and an opening adapted to receive a lower portion of a flower pot wherein the opening is offset from a central portion of the sheet of material in a direction generally away from the indicia bearing portion of the sheet of material.
Figure 7:
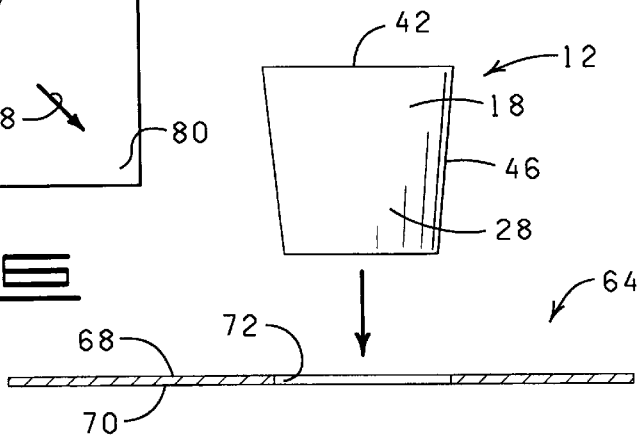
FIG. 7 is a side elevational view, partially in cross section, of the sheet of material of FIG. 6 having a flower pot positioned above the opening in the sheet of material.

As more clearly shown in FIGS. 6 and 7, the sheet of material 64 has an upper surface 68, a lower surface 70, an opening 72 adapted to receive the lower portion 28 of the flower pot 12 and an extension 74 containing design indicia 76. The opening 72 in the sheet of material 64 is offset relative to the overall configuration of the sheet of material 64 in a direction 78 generally away from the extension 74 of the sheet of material 64 substantially as shown. The sheet of material 64 has three substantially square-shaped corners 80, 82 and 84, the sheet extension 74 defining the other corner. The sheet of material 64 is sized so that when the lower portion 28 of the flower pot 12 is disposed in the opening 72 in the sheet of material 64 and the sheet of material 64 is wrapped or formed about the upper portion 18 of the flower pot 12, the decorative flower pot cover 60 so formed is provided with the indicia bearing portion 62 and three accentuated flared petal-like portions 86, 88 and 90, each of which terminates with a substantially pointed end 92 formed by the three substantially square-shaped corners 80, 82 and 84 of the sheet of material 64. Further, the extension 74 of the sheet of material 64 is sized such that when the sheet of material 64 is formed unto the decorative flower pot cover 60, the indicia bearing portion 62 of the decorative flower pot cover 60 extends above the three accentuated flared petal-like portions 86, 88 and 90 of the decorative flower pot cover 60.

The sheet of material 64 used in the construction of the decorative flower pot cover 60 has a substantially planar cross-section and a thickness in a range of from about 0.1 mil to about 30 mils, and more desirably from about 1 mil to about 10 mils. However, it should be understood that the thickness of the sheet of material 64 may vary depending on the type of material from which the sheet of material 64 is constructed. That is, it should be understood that the sheet of material 64 can have any thickness so long as the sheet of material 64 retains sufficient flexibility and foldability so that the sheet of material 64 can be disposed about the flower pot 12 and shaped to form the decorative flower pot cover 60 thereabout. For example, the sheet of material 64 can be constructed of paper, metal foil, natural organic polymer films, synthetic organic polymer films, cling wrap, cloth, burlap and/or combinations thereof.

Although the sheet of material 64 has been shown and described herein as having a modified square-shaped configuration having the extension 74 containing design indicia 76 forming one corner thereof, it should be understood that the sheet of material 64 may assume any geometric, non-geometric, asymmetrical or fanciful shape having any appropriate size so long as the sheet of material 64 is provided with the extension 74 containing design indicia 76 and the sheet of material 64 can be disposed about the flower pot 12 to form the decorative flower pot cover 60 thereabout.

A decorative pattern, such as a color and/or an embossed pattern, and/or a hologram and/or other decorative surface ornamentation may be applied to the upper and/or lower surfaces 68 and 70 of the sheet of material 64 or portions thereof, including but not limited to printed designs, coatings, colors, flocking or metallic finishes. Further, the sheet of material 64 may be totally clear or partially clear or a tinted transparent material.

Referring more specifically to FIG. 7, the decorative flower pot cover 60 is formed about the flower pot 12 by inserting the lower portion 28 of the flower pot 12 through the opening 72 in the sheet of material 64 such that a portion of the sheet of material 64 adjacent the opening 72 therein frictionally engages a portion of a sidewall 46 of the flower pot 12. The sheet of material 64 is then formed about the upper portion 18 of the flower pot 12 to produce the decorative flower pot cover 60 for the flower pot 12 while maintaining the open upper end 42 of the flower pot 12 substantially uncovered by the decorative flower pot cover 10.

To connect the decorative flower pot cover 60 to the sidewall 46 of the flower pot 12, the ring of adhesive 66 is positioned on the upper surface 68 of the sheet of material 64 so as to extend around the opening 72 in the sheet of material 64. Thus, when the sheet of material 64 is formed about the upper portion 18 of the flower pot 12, the portion of the sheet of material 64 surrounding the opening 72 having the adhesive 66 deposited thereon and which frictionally engages the sidewall 46 of the flower pot 12 when the sheet of material is formed into the decorative flower pot cover 60 is adhesively connected to the sidewall 46 of the flower pot 12.

Figure 8:
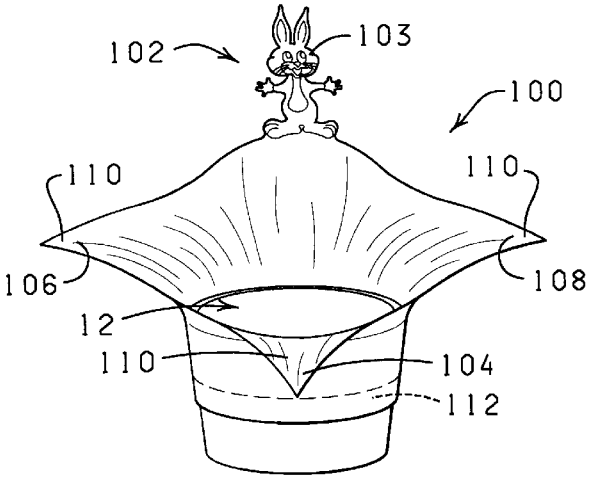
FIG. 8 is a perspective view of another embodiment of a decorative flower pot cover constructed in accordance with the present invention, the decorative flower pot cover having an indicia bearing design extending above the remainder of the decorative flower pot cover so as to enhance the visual aesthetic effect of the decorative flower pot cover.

FIG. 8 is a perspective view of another embodiment of a decorative flower pot cover 100 constructed in accordance with the present invention. The decorative flower pot cover 100 is substantially identical in construction as the decorative flower pot cover 60 hereinbefore described with reference to FIG. 5, with the exception that an indicia bearing portion 102 of the decorative flower pot cover 100 is a cutout FIG. 103. That is, the decorative flower pot cover 100 is provided with the cutout FIG. 103, and three accentuated, flared petal-like portions 104, 106 and 108. The accentuated, flared petal-like portions 104, 106 and 108 each terminates with a substantially pointed end 110. Further, the sheet of material containing the cutout FIG. 103 from which the decorative flower pot cover 100 is constructed is sized such that when such sheet of material is formed into the decorative flower pot cover 100, the cutout FIG. 103 of the decorative flower pot cover 100 extends above the three accentuated, flared, petal-like portions 104, 106 and 108 of the decorative flower pot cover substantially as shown.

The decorative flower pot cover 100 can be secured about the flower pot 12 using any of the before-mentioned bonding materials, such as a ring of adhesive 112 positioned on an upper surface (not shown) of a sheet of material (also not shown) in the same manner as the ring of adhesive 66 is positioned on the upper surface 68 of the sheet of material 64 hereinbefore described with reference to the decorative flower pot cover 60. Thus, when the sheet of material from which the decorative flower pot cover 100 is formed is wrapped about the upper portion 18 of the flower pot 12, the portion of the decorative cover 100 frictionally engaging the sidewall 46 of the flower pot 12 is adhesively connected to the flower pot 12 by the adhesive 112.

Figure 9:
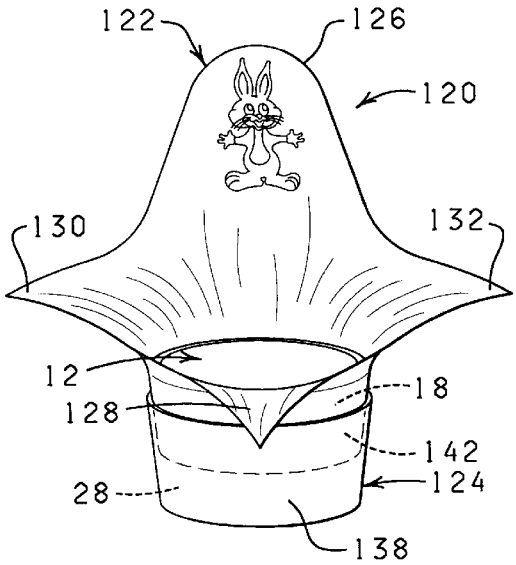
FIG. 9 is a perspective view of the decorative flower pot cover of FIG. 5 having a closed bottom portion extending about a lower portion of the flower pot.

Referring now to FIG. 9, shown therein is another embodiment of a decorative flower pot cover 120 disposed about the flower pot 12. The decorative flower pot cover 120 is provided with an indicia upper portion 122 and a lower portion 124. The indicia bearing upper portion 122 of the decorative flower pot cover 120 is formed from a sheet of material substantially identical in construction as the sheet of material 64 hereinbefore described in detail with reference to FIGS. 6 and 7 and its formation into the decorative flower pot cover 60 shown in FIG. 5. Thus, the indicia bearing upper portion 122 of the decorative flower pot cover 120 is provided with an indicia bearing extension 126 and three accentuated, flared, petal-like portions 128, 130 and 132. As shown, the indicia bearing extension 126 extends above the three flared petal-like portions 128, 130 and 132 of the indicia bearing upper portion 122 of the decorative flower pot cover 120.

The indicia bearing upper portion 122 of the decorative flower pot cover 120 can be secured about the upper portion 18 of the flower pot 12 by any suitable bonding material. For example, the indicia bearing upper portion 122 of the decorative flower pot cover 120 can be secured about the upper portion 18 of the flower pot 12 with a band, such as used to secure the decorative cover 10 about the flower pot 12 (FIG. 1) or an adhesive as used to secure the decorative cover 60 about the upper portion 18 of the flower pot 12 (FIG. 5).

Figure 10:
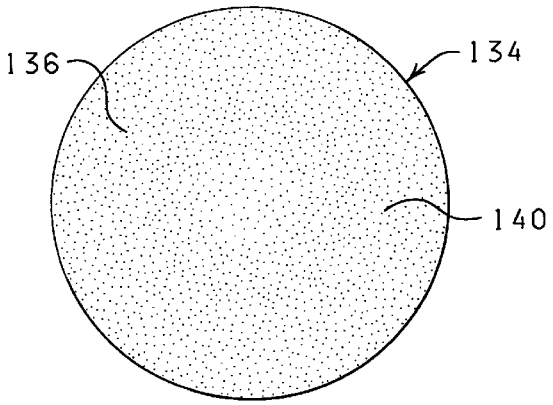
FIG. 10 is a top plan view of a sheet of material having a substantially circular configuration used in the construction of the closed bottom portion of the decorative flower pot cover of FIG. 8.

Referring now to FIG. 10, shown therein is a sheet of material 134 for forming the lower portion 124 of the decorative flower pot cover 120. The sheet of material 134 has an upper surface 136 and a lower surface 138. A bonding material, such as an adhesive material 140 is applied to the upper surface 136 of the sheet of material 134. Thus, when the sheet of material 134 is wrapped about the lower portion 28 of the flower pot 12 to form the lower portion 124 of the decorative flower pot cover 120, the lower portion 124 of the decorative flower pot cover 120 is bondingly connected to the flower pot 12 and to an underlying portion 142 of the indicia bearing upper portion 122 by the adhesive material 140.

Figure 11:
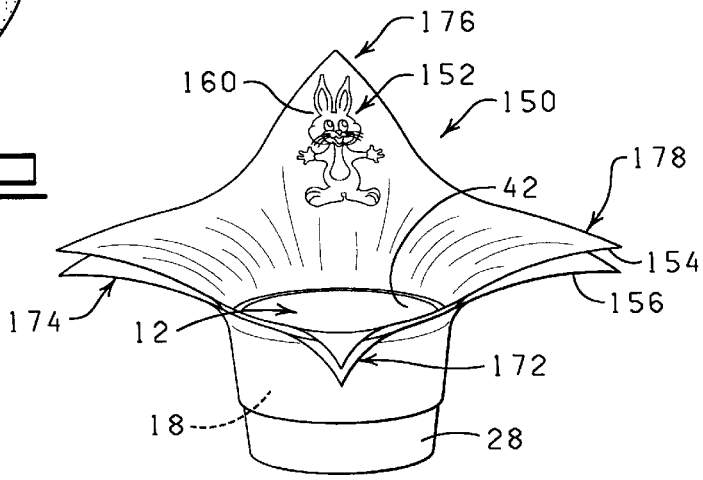
FIG. 11 is another embodiment of a decorative flower pot cover constructed in accordance with the present invention, the decorative flower pot cover formed of a plurality of sheets of material wherein at least one of the sheet of material has an indicia bearing portion which extends above the remainder of the decorative flower pot cover so as to enhance the visual aesthetic effect of the decorative flower pot cover.
Figure 12:
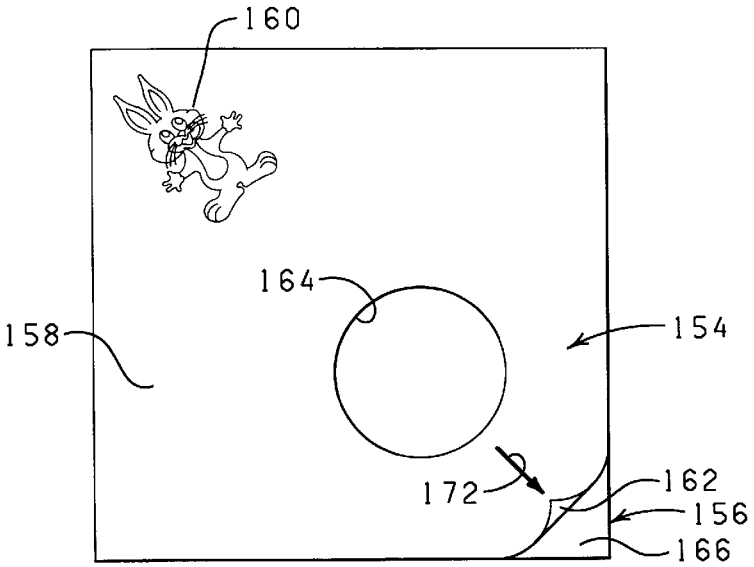
FIG. 12 is a top plan view of two sheets of material having a substantially square-shaped configuration used in the production of the decorative flower pot cover of FIG. 11, a portion of the upper sheet of material being turned upwardly to show the lower sheet of material.

Referring now to FIGS. 11 and 12, shown therein is a multi-layered decorative flower pot cover 150 disposed about the upper portion 18 of the flower pot 12. The multi-layered decorative flower pot cover 150 is provided with an indicia bearing portion 152 which enhances the visual aesthetic effect of the multi-layered decorative flower pot cover 150. The decorative flower pot cover 150, which comprises at least two sheets of material, such as a first or upper sheet of material 154 and a second or lower sheet of material 156, is formed by wrapping the first and second sheets of material 154, 156 (FIGS. 12 and 13) about the upper portion 18 of the flower pot 12. The decorative flower pot cover 150 can then be secured about the upper portion 18 of the flower pot 12 by any suitable bonding material, such as a band, an adhesive, a ribbon or a tie.

Figure 13:
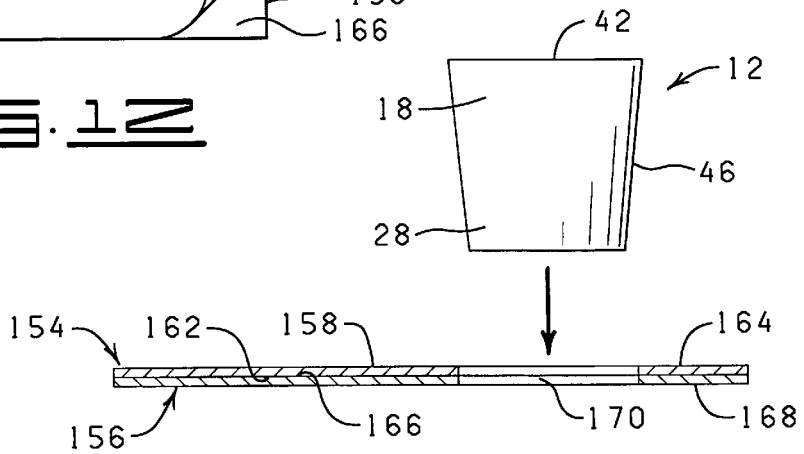
FIG. 13 is a side elevational view, partially in cross section, of the two sheets of material of FIG. 11 having a flower pot positioned above the openings in the sheets of material.

As more clearly shown in FIGS. 12 and 13, the first sheet of material 154 has an upper surface 158 having a design indicia 160 provided thereon, a lower surface 162 and an opening 164 extending through a portion thereof. Similarly, the second sheet of material 156 has an upper surface 166, a lower surface 168 and an opening 170 extending through a portion thereof. If desired, the upper and/or lower surfaces 166 and 168 of the second sheet of material 156 may also contain a design indicia. The openings 164 and 170 of the first and second sheets of material 154 and 156 are offset from a central portion thereof (FIGS. 12 and 13) in a direction 172 generally away from the design indicia 160;

and the openings 164 and 170 of the first and second sheets of material 154, 156 are shaped and dimensioned to receive the lower portion 28 of the flower pot 12 so that, upon positioning the lower portion 28 of the flower pot 12 through the openings 164 and 170 in the first and second sheets of material 154, 156, the first and second sheets of material 154 and 156 can be formed about the upper portion 18 of the flower pot 12 to produce the multi-layered decorative flower pot cover 150. It should be noted that the openings 164 and 170 in the first and second sheets of material 154 and 156 can be substantially identical in size as shown in FIG. 13, or the openings 164 and 170 in the first and second sheets of material 154 and 156 may be of different sizes so that the first and second sheets of material 154 and 156 are spatially disposed relative to one another along the upper portion 18 of the flower pot 12.

The first and second sheets of material 154 and 156 are depicted as having a substantially square-shaped configuration and each of the first and second sheets of material 154 and 156 are sized so that when the lower portion 28 of the flower pot 12 is disposed in the openings 164 and 170 of the first and second sheets of material 154 and 156, and the first and second sheets of material 154 and 156 are wrapped or formed about the upper portion 18 of the flower pot 12, the multi-layered decorative flower pot cover 150 so formed is provided with four accentuated flared petal-like portions 172, 174, 176 and 178, each of which terminates with a substantially pointed end substantially as shown. Three of the petal-like portions 172, 174 and 178 extend a distance upwardly and outwardly from the open upper end 42 of the flower pot 12 and the petal-like portion 176 which contains the design indicia 160 and thus forms the indicia bearing portion 152 of the multi-layered decorative flower pot cover 150, extends in an upward direction from the open upper end 42 of the flower pot 12 substantially as shown so as to enhance the visual aesthetic effect of the multi-layered decorative flower pot cover 150.

The design indicia 160 may be provided on the first and second sheets of material 154 and 156, such as the upper surface 158 of the first sheet of material 154, by application of a dye, ink and/or pigment such that, upon forming the first and second sheets of material 154 and 156 into the multi-layered decorative flower pot cover 150, the multi-layered decorative flower pot cover 150 is provided with the design indicia bearing portion 152. Such dyes, inks and/or pigments are known in the art and are commercially available, and may be applied to the first sheet of material 154 and/or the second sheet of material 156 by any known method in the art. In addition, the design indicia 160 may be a hologram and/or an outline configuration, or a hologram and/or outline configuration in combination with a printed portion.

Referring now to FIG. 13, the formation of the multi-layered decorative flower pot cover 150 will be more fully described. In forming the multi-layered decorative flower pot cover 150 about the flower pot 12, the lower portion 28 of the flower pot 12 is inserted through the openings 164 and 170 in the first and second sheets of material 154 and 156, respectively, such that a portion of the first sheet of material 154 adjacent the opening 164 of the first sheet of material 154 frictionally engages a portion of the sidewall 38 of the flower pot 12 and a portion of the second sheet of material 156 adjacent the opening 170 of the second sheet of material 156 overlaps and frictionally engages the underlying portion of the first sheet of material 154. The first and second sheets of material 154 and 156 are then formed about the upper portion 18 of the flower pot 12 to produce the multi-layered decorative flower pot cover 150 disposed about the flower pot 12 such that the open upper end 42 of the flower pot 12 remains substantially uncovered by the multi-layered decorative flower pot cover 150 (FIG. 11).

To enhance connection of the portions of the first and second sheets of material 154 and 156 adjacent their respective openings 164 and 170, one can employ an adhesive to bondingly connect the portion of the first sheet of material 156 frictionally engaging the sidewall 38 of the flower pot 12 and an adhesive to bondingly connect the portion of the second sheet of material 156 to the underlying portion of the first sheet of material 154. In the alternatively, one can use any other type of bonding material, such as an elastic band, a tie, a ribbon and the like, to secure the portion of the first and second sheets of material 154 and 156 adjacent the openings 164 and 170 in the first and second sheets of material 154 and 156 to a portion of the sidewall 38 of the flower pot 12.

When the multi-layered decorative flower pot cover 150 is disposed about the flower pot 12, the multi-layered decorative flower pot cover 150 extends circumferentially about and substantially encompasses the upper portion 18 of the flower pot 12. In this position, the first sheet of material 154 and the second sheet of material 156 forming the multi-layered decorative flower pot cover 150 extends substantially independent of one another in an upwardly and outwardly angular direction from the sidewall 38 of the flower pot 12 so that the open upper end 42 of the flower pot 12 remains substantially uncovered by the multi-layered decorative flower pot cover 150.

The first and second sheets of material 154 and 156 have a substantially planar cross-section and a thickness in the range of from about 0.1 mil to about 30 mils, and more desirably from about 1.0 mil to about 10.0 mils. However, it should be understood that the thickness of the first and second sheets of material 154 and 156 may vary depending on the type of material used in the construction of the first and second sheets of material 154 and 156. That is, the first and second sheets of material 154 and 156 can have any thickness so long as the first and second sheets of material 154 and 156 retain sufficient flexibility and foldability so that when the lower portion 28 of the flower pot 12 is disposed in the openings 164 and 170 of the first and second sheets of material 154 and 156, the first and second sheets of material 154 and 156 can be shaped and formed about the upper portion 18 of the flower pot 12 to produce the multi-layered decorative flower pot cover 150 for the flower pot 12.

For example, the first and second sheets of material 154 and 156 can be constructed of paper, foil, natural organic polymer films, synthetic organic polymer films, cling wrap, cloth, burlap and/or combinations thereof. The first and second sheets of material 154 and 156 may also be constructed of the same type of material or different types of material and the choice of material for the first and second sheets of material 154 and 156 will depend upon the appearance sought in the multi-layered decorative flower pot cover 150.

A decorative pattern, such as a color and/or embossed pattern, a hologram and/or other decorative surface ornamentation may be applied to the upper surface and/or lower surfaces 154 and 162 of the first sheet of material 154 and/or the upper surface 166 and/or the lower surface (not shown) of the second sheet of material 156, or portions thereof, including but not limited to printed designs, coatings, colors, flocking or metallic finishes. The first and second sheets of material 154 and 156, with the exception of the design indicia 160, may be totally or partially clear or tinted transparent material.

Although the first and second sheets of material 154 and 156 have been shown in FIGS. 12 and 13 as having a substantially square-shaped configuration, it should be understood that the first and second sheets of material 154 and 156 may have any geometric, non-geometric, asymmetrical or fanciful configuration having any appropriate size so long as the first and second sheets of material 154 and 156 can be provided with their respective openings 164 and 170, and can be formed about the upper portion 18 of the flower pot 12 to form the multi-layered decorative flower pot cover 150 for the flower pot 12.

Figure 14:
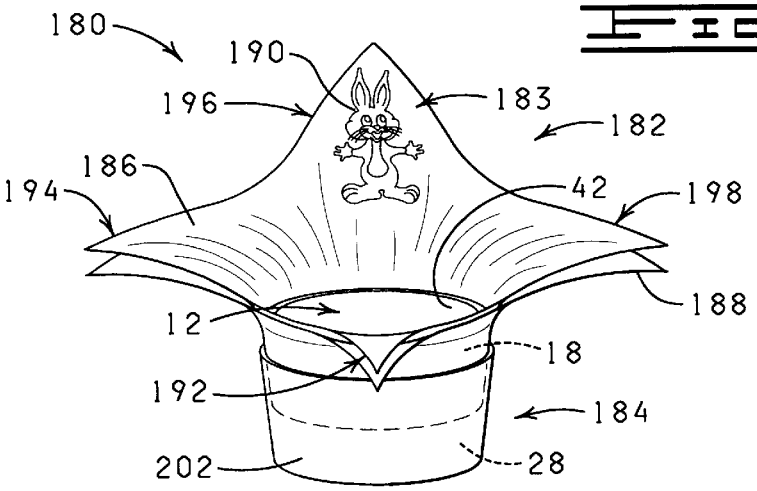
FIG. 14 is a perspective view of the decorative flower pot cover of FIG. 11 having a closed bottom portion extending about a lower portion of the flower pot.
Figure 16:
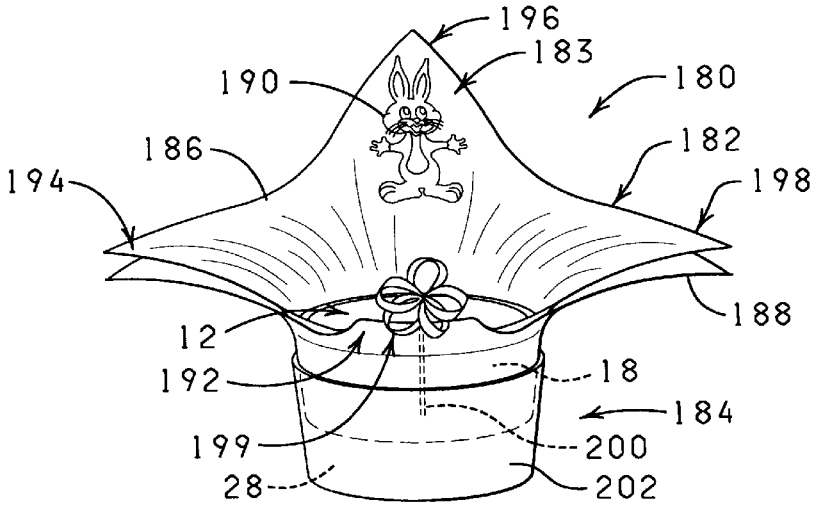
FIG. 16 is a perspective view of the decorative flower pot cover of FIG. 14 wherein a portion of the decorative flower pot cover opposite the indicia bearing portion is folded inwardly into an open upper end of a flower pot.

Referring now to FIGS. 14 and 16, shown therein is a decorative flower pot cover 180 disposed about of the flower pot 12. The decorative flower pot cover 180 is provided with a multi-layered upper portion 182 having an indicia bearing portion 183 and a lower portion 184. The multi-layered upper portion 182 of the decorative flower pot cover 180 is formed of two or more sheets of material, such as first and second sheets of material 186 and 188. The first and second sheets of material 186 and 188 are substantially identical in construction as the first and second sheets of material 154 and 156 of the multi-layered decorative cover 150 hereinbefore described in detail with reference to FIGS. 11–13. That is, each of the first and second sheets of material 186 and 188 has a substantially square-shaped configuration and an opening (not shown) which is shaped and dimensioned to receive the lower portion 28 of the flower pot 12; and the first sheet of material 186 is provided with a design indicia 190.

To form the multi-layered upper portion 182 of the decorative flower pot cover 180 about the flower pot 12, the lower portion 28 of the flower pot 12 is inserted through the openings (not shown) in the first and second sheets of material 186 and 188 such that a portion of the first sheet of material 186 adjacent the opening of the first sheet of material 186 frictionally engage a portion of the sidewall 46 of the flower pot 12 and a portion of the second sheet of material 188 adjacent the opening in the second sheet of material 188 overlays the portion of the first sheet of material 186 frictionally engaging the sidewall 46 of the flower pot 12. Thus, the first and second sheets of material 186 and 188 are secured about the flower pot 12 in substantially the same manner as the first and second sheets of material 154 and 156 are secured about the flower pot 12. The first and second sheets of material 186 and 188 are then formed about the upper portion 18 of the flower pot 12 to produce the multi-layered upper portion 182 of the decorative flower pot cover 180.

The multi-layered decorative flower pot cover 180 is provided with four accentuated flared petal-like portions 192, 194, 196 and 198, each of which terminates with a substantially pointed end substantially as shown. As shown in FIG. 14, three of the petal-like portions 192, 194 and 198 extend a distance upwardly and outwardly from the open upper end 42 of the flower pot 12 and the petal-like portion 196, which contains the design indicia 190, and thus forms the indicia bearing portion 183 of the multi-layered decorative flower pot cover 180, extends in an upward direction from the open upper end 42 of the flower pot 12 substantially as shown so as to enhance the visual aesthetic effect of the multi-layered decorative flower pot cover 180. As an alternative, the accentuated flared petal-like portion 192 can be folded inwardly into the open upper end 42 of the flower pot 12 substantially as shown in FIG. 16 so that a decorative item, such as bow 199, or a greeting card, or a card containing other information can be secured to a support member 200 which is partially embedded in potting media (not shown) disposed within the flower pot 12.

The design indicia 190 may be provided on the first and second sheets of material 186 and 188, such as the upper surface of the first sheet of material 186, by application of a dye, ink and/or pigment such that, upon forming the first and second sheets of material 186 and 188 into the multi-layered decorative flower pot cover 180, the multi-layered decorative flower pot cover 180 is provided with the design indicia bearing portion 183. Such dyes, inks and/or pigments are known in the art and are commercially available, and may be applied to the first sheet of material 186 and/or the second sheet of material 188 by any known method in the art. In addition, the design indicia 190 may be a hologram and/or an outline configuration, or a hologram and/or outline configuration in combination with a printed portion.

To enhance connection of the portion of the first sheet of material 186 to a portion of the sidewall 38 of the flower pot 12 and a portion of the second sheet of material 188 to the underlying portion of the first sheet of material 186 frictionally engaging the sidewall 46 of the flower pot 12, one can employ an adhesive to bondingly connect the portion of the first sheet of material 186 frictionally engaging the sidewall 46 of the flower pot 12 to the sidewall 48 and an adhesive to bondingly connect the portion of the second sheet of material 188 to the underlying portion of the first sheet of material 186 adhesively connected to a portion of the sidewall 46 of the flower pot 12.

When the multi-layered upper portion 182 of the decorative flower pot cover 180 is disposed about the flower pot 12, the multi-layered upper portion 182 extends circumferentially about and substantially encompasses the upper portion 18 of the flower pot 12. In this position, the first sheet of material 186 and the second sheet of material 188 forming the multi-layered upper portion 182 of the decorative flower pot cover 180 extend substantially independent of one another in and upwardly and outwardly angular direction from the sidewall 46 of the flower pot 12 so that the open upper end 42 of the flower pot 12 remains substantially uncovered by the multi-layered upper portion 182 of the decorative flower pot cover 180.

Figure 15:
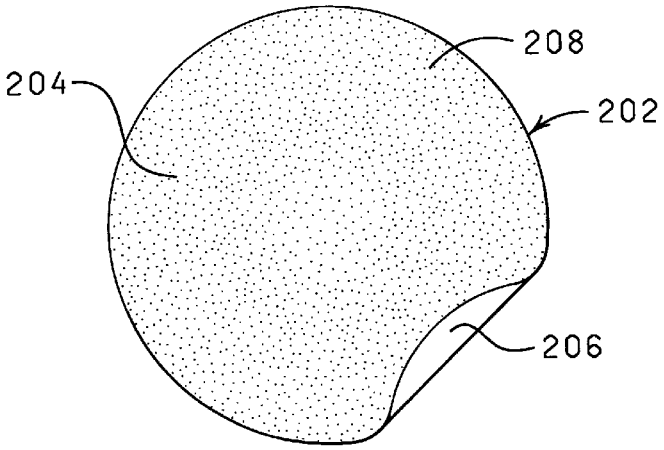
FIG. 15 is a top plan view of a sheet of material having a substantially circular configuration used in the construction of the closed bottom portion of the decorative flower pot cover of FIG. 14, a portion of the sheet of material being turned upwardly to show the lower surface of the sheet of material.

Referring now to FIG. 15, shown therein is a sheet of material 202 for forming the lower portion 184 of the decorative flower pot cover 180. The sheet of material 202 has an upper surface 204 and a lower surface 206. To form the lower portion 184 of the decorative flower pot cover 180, the sheet of material 202 is wrapped about the lower portion 28 of the flower pot 12 such that a portion of the lower portion 184 of the decorative flower pot cover 180 overlays a portion of the multi-layered upper portion 182 of the decorative flower pot cover 180 substantially as shown. It should be noted that the bottom portion 184 of the decorative flower pot cover 180 can be positioned over the lower portion 28 of the flower pot 12 prior to wrapping the first and second sheets of material about the upper portion 18 of the flower pot 12 to form the multi-layered upper portion 182 of the decorative flower pot cover 180.

To secure the lower portion 184 of the decorative flower pot cover 180 about the lower portion 28 of the flower pot 12 and to the underlying portion of the multi-layered upper portion 182 of the decorative flower pot cover 180, an adhesive material 208 is provided on the upper surface 204 of the sheet of material 202. In the embodiment shown in FIG. 15, the adhesive material 208 is shown disposed on the entire upper surface 204 of the sheet of material 202.

However, it should be understood that the adhesive material 208 can be positioned on only portions of the upper surface 204 of the sheet of material 202 and can be applied in any pattern, such as a plurality of dots, strips, squares and the like. It should also be understood that any other suitable bonding materials such as ribbons, bands, ties and the like can be used to secure the multi-layered upper portion 182 and the lower portion 184 of the decorative flower pot cover about the flower pot 12.

The sheet of material 202 which can be used to form the lower portion 184 of the decorative flower pot cover 180 is shown in FIG. 15 as having a substantially circular configuration. However, it should be understood that the sheet of material 202 may have any geometric, non-geometric, asymmetrical or fanciful configuration having any appropriate size so long as the sheet of material 202 can be wrapped or folded about the lower portion 28 of the flower pot 12 and a portion of the multi-layered upper portion 182 of the decorative flower pot cover 180 substantially as shown in FIGS. 14 and 16.

The sheet of material 202 has a substantially planar cross-section and a thickness in the range of from about 0.1 mil to about 30 mils, and more desirably from about 1.0 mil to about 10.0 mils. However, it should be understood that the thickness of the sheet of material 202 may vary depending on the type of material used in the construction of the sheet of material 202. That is, the sheet of material 202 can have any thickness so long as the sheet of material 202 retains sufficient flexibility and foldability so that the sheet of material 202 can be wrapped or folded about the lower portion 28 of the flower pot 12 and at least a portion of the multi-layered upper portion 182 of the decorative flower pot cover 180 substantially as shown in FIGS. 14 and 16.

For example, the sheet of material 202 can be constructed of paper, foil, natural polymeric films, synthetic polymeric films, cling wrap, cloth, burlap and/or combinations thereof. The sheet of material 202 may also be constructed of the same type of material or different types of material as the first sheet of material 56 and the second sheet of material 58 forming the multi-layered upper portion 52 of the decorative flower pot cover 50; and the choice of material for the sheet of material 202 will depend upon the appearance sought in the decorative flower pot cover 180.

A decorative pattern, such as a color and/or embossed pattern, a hologram and/or other decorative surface ornamentation may be applied to the sheet of material 202 or to portions thereof, including but not limited to printed designs, coatings, colors, flocking or metallic finishes. The sheet of material 202 may be totally or partially clear or tinted transparent material.

While certain embodiments of a decorative flower pot cover have been described in detail herein, it should be understood that changes may be made in the construction and operation of the various components and assemblies described herein and changes may be made in the steps or the sequence of steps of the methods described herein without departing from the spirit and the scope of the invention as defined in the following claims.

What is claimed is:

1. A method for providing a decorative cover for a flower pot, comprising the steps of:

providing a sheet of material having a design indicia bearing portion and an opening extending therethrough, the opening being offset from a central portion of the sheet of material;

providing a flower pot having a lower portion, an upper portion and an open upper end;

disposing a lower portion of the flower pot through the opening in the sheet of material; and wrapping the sheet of material about the upper portion of the flower pot to provide a decorative cover about at least the upper portion of the flower pot wherein the open upper end of the flower pot remains substantially uncovered by the decorative cover, the design indicia bearing portion of the sheet of material forming a portion of the decorative cover which enhances the visual aesthetic effect of the decorative cover.

2. The method for providing a decorative cover for a flower pot of claim 1 wherein the sheet of material is provided with a substantially square-shaped configuration having four corners and wherein the decorative cover comprises four petal-like portions formed by the corners of the sheet of material, the petal-like portions being flared so as to extend a distance upwardly and outwardly from the flower pot when the sheet of material is wrapped about the upper portion of the flower pot.

3. The method for providing a decorative cover for a flower pot of claim 2 wherein, in the step of wrapping the sheet of material about the upper portion of the flower pot to provide a decorative cover, overlapping portions are formed in at least a portion of the decorative cover, and wherein the sheet of material further comprises a bonding material disposed on at least a portion of the sheet of material whereby at least a portion of the overlapping portions of the decorative cover are bonded via the bonding material.

4. The method for providing a decorative cover for a flower pot of claim 3 further comprising the step of positioning a band about a portion of the decorative cover to secure the decorative cover about the upper portion of the flower pot.

5. The method for providing a decorative cover for a flower pot of claim 4 wherein the sheet of material is constructed of a flexible material selected from the group consisting of paper, metal foil, natural polymer films, synthetic polymer films, cling wrap, cloth, burlap and combinations thereof.

6. The method for providing a decorative cover for a flower pot of claim 5 wherein the sheet of material has a thickness in a range of from about 0.1 mil to about 30 mils.

7. The method for providing a decorative cover for a flower pot of claim 1 wherein, in the step of wrapping the sheet of material about the upper portion of the flower pot to provide a decorative cover, overlapping portions are formed in at least a portion of the decorative cover, and wherein the sheet of material further comprises a bonding material disposed on at least a portion of the sheet of material such that upon wrapping the sheet of material about the upper portion of the flower pot to provide the decorative cover, at least a portion of the overlapping portions of the decorative cover are bonded via the bonding material.

8. The method for providing a decorative cover for a flower pot of claim 1 further comprising the step of positioning a band about a portion of the decorative cover to secure the decorative cover about the upper portion of the flower pot.

9. The method for providing a decorative cover for a flower pot of claim 1 wherein the sheet of material is constructed of a flexible material selected from the group consisting of paper, metal foil, natural polymer films, synthetic polymer films, cling wrap, cloth, burlap and combinations thereof.

10. The method for providing a decorative cover for a flower pot of claim 1 wherein the sheet of material has a thickness in a range of from about 0.1 mil to about 30 mils.

11. A method for providing a decorative cover for a flower pot wherein the decorative cover is provided with a design indicia bearing upper portion and a lower portion, the method comprising the steps of:

providing a flower pot having an upper portion, a lower portion and an open upper end;

providing a first sheet of material having a design indicia and an opening extending therethrough sized to receive the lower portion of the flower pot, the opening being offset from a central portion of the first sheet of material;

disposing the lower portion of the flower pot through the opening in the first sheet of material and wrapping the first sheet of material about the upper portion of the flower pot to provide the indicia bearing upper portion of the decorative cover wherein the open upper end of the flower pot remains substantially uncovered by the decorative cover;

providing a second sheet of material;

wrapping the second sheet of material about the lower portion of the flower pot so as to form the lower portion of the decorative cover; and bondingly connecting the indicia bearing upper portion of the decorative cover and the lower portion of the decorative cover about the flower pot such that the open upper end of the flower pot remains substantially uncovered by the indicia bearing upper portion of the decorative cover.

12. The method for providing a decorative cover for a flower pot of claim 11 wherein the first sheet of material is provided with a substantially square-shaped configuration having four corners and wherein the indicia bearing upper portion of the decorative cover comprises four petal-like portions formed by the corners of the first sheet of material, the petal-like portions being flared so as to extend a distance upwardly and outwardly from the open upper end of the flower pot.

13. The method for providing a decorative cover for a flower pot of claim 12 wherein the second sheet of material is characterized as having a upper surface, a lower surface and bonding material disposed on at least a portion of the upper surface such that, upon wrapping the second sheet of material about the lower portion of the flower pot to form the lower portion of the decorative flower pot cover, at least a portion of the lower portion of the decorative flower pot cover is bondingly connected to a lower portion of the flower pot.

14. The method for providing a decorative cover for a flower pot of claim 13 wherein the second sheet of material is provided with a substantially circular configuration and is sized such that, upon wrapping the second sheet of material about the lower portion of the flower pot to form the lower portion of the decorative cover, the lower portion of the decorative cover extends about the lower portion of the flower pot and overlay an adjacently disposed portion of the indicia bearing upper portion of the decorative cover.

15. The method for providing a decorative cover for a flower pot of claim 14 further comprising the step of positioning a band about a portion of the indicia bearing upper portion of the decorative cover to secure the indicia bearing upper portion of the decorative cover about the upper portion of the flower pot.

16. The method for providing a decorative cover for a flower pot of claim 15 wherein the first and second sheets of material are each constructed of a flexible material selected from the group consisting of paper, metal foil, natural polymer films, synthetic polymer films, cling wrap, cloth, burlap and combinations thereof.

17. The method for providing a decorative cover for a flower pot of claim 16 wherein the first and second sheets of material each have a thickness in a range of from about 0.1 mil to about 30 mils.

18. The method for providing a decorative cover for a flower pot of claim 11 wherein the second sheet of material is characterized as having a upper surface, a lower surface and bonding material disposed on at least a portion of the upper surface such that, upon wrapping the second sheet of material about the lower portion of the flower pot to form the lower portion of the decorative flower pot cover, at least a portion of the lower portion of the decorative flower pot cover is bondingly connected to a lower portion of the flower pot.

19. The method for providing a decorative cover for a flower pot of claim 11 wherein the second sheet of material is provided with a substantially circular configuration and is sized such that upon wrapping the second sheet of material about the lower portion of the flower pot to form the lower portion of the decorative cover, the lower portion of the decorative cover extends about the lower portion of the flower pot and overlay an adjacently disposed portion of the indicia bearing upper portion of the decorative cover.

20. The method for providing a decorative cover for a flower pot of claim 11 further comprising the step of positioning a band about a portion of the indicia bearing upper portion of the decorative cover to secure the indicia bearing upper portion of the decorative cover about the upper portion of the flower pot.

21. The method for providing a decorative cover for a flower pot of claim 11 wherein the first and second sheets of material are flexible sheets of material and each of the first and second flexible sheets of material are constructed of a material selected from the group consisting of paper, metal foil, natural polymer films, synthetic polymer films, cling wrap, cloth, burlap and combinations thereof.

22. The method for providing a decorative cover for a flower pot of claim 21 wherein the first and second sheets of material each have a thickness in a range of from about 0.1 mil to about 30 mils.

23. A method for providing a decorative cover for a flower pot, comprising the steps of:

providing two or more first sheets of material, each of the first sheets of material having a design indicia bearing portion and an opening extending therethrough wherein the opening is offset from a central portion of the first sheets of material;

providing a flower pot having a lower portion, an upper portion and open upper end;

disposing a lower portion of the flower pot through the openings in the first sheets of material; and wrapping the first sheets of material about the upper portion of the flower pot to provide a decorative cover about the upper portion of the flower pot such that the open upper end of the flower pot remains substantially uncovered by the decorative cover, the design indicia bearing portions of the first sheets of material forming a portion of the decorative cover which enhances the visual aesthetic effect of the decorative cover.

24. The method for providing a decorative cover for a flower pot of claim 23 wherein at least one of the first sheets of material is provided with a substantially square-shaped configuration having four corners and wherein the decorative cover comprises at least four petal-like portions formed by the corners of at least one of the first sheets of material, the petal-like portions being flared so as to extend a distance upwardly and outwardly from the flower when the first sheets of material are wrapped about the upper portion of the flower pot.

25. The method for providing a decorative cover for a flower pot of claim 24 wherein, in the step of wrapping the first sheets of material about the upper portion of the flower pot to provide a decorative cover, over lapping portions are formed in the decorative cover, and wherein the first sheets of material further comprise a bonding material disposed on at least a portion of each of the first sheets of material such that upon wrapping the first sheets of material about the upper portion of the flower pot to provide the decorative cover, at least a portion of the overlapping portions of the decorative cover are bonded via the bonding material.

26. The method for providing a decorative cover for a flower pot of claim 25 further comprising the step of positioning a band about a portion of the decorative cover to secure the decorative cover about the upper portion of the flower pot.

27. The method for providing a decorative cover for a flower pot of claim 26 wherein the first sheets of material are flexible sheets of material constructed of a material selected from the group consisting of paper, metal foil, natural polymer films, synthetic polymer films, cling wrap, cloth, burlap and combinations thereof.

28. The method for providing a decorative cover for a flower pot of claim 27 wherein the sheet of material has a thickness in a range of from about 0.1 mil to about 30 mils.

29. The method for providing a decorative cover for a flower pot of claim 23 further comprising:

providing a second sheet of material; and wrapping the second sheet of material about the lower portion of the flower pot.

30. The method for providing a decorative cover for a flower pot of claim 29 further comprising:

bondingly connecting at least a portion of the decorative cover formed by wrapping the first sheets of material about the upper portion of the flower pot to the upper portion of the flower pot and at least a portion of the decorative cover formed by wrapping the second sheet of material about the lower portion of the flower pot to a lower portion of the flower pot.

31. The method for providing a decorative cover for a flower pot of claim 29 wherein the first sheets of material wrapped about the upper portion of the flower pot have a substantially square-shaped configuration having four corners and wherein the second sheet of material wrapped about the lower portion of the flower pot has a substantially circular configuration.

32. The method for providing a decorative cover for a flower pot of claim 29 wherein the second sheet of material is sized such that, upon wrapping the second sheet of material about the lower portion of the flower pot, a portion of the second sheet is disposed adjacent a portion of the first sheets of material wrapped about the upper end portion of the flower pot.

33. The method for providing a decorative cover for a flower pot of claim 32 further comprising the step of positioning a band about the portion of the second sheet disposed adjacent the portion of the first sheets of material when the first and second sheets of material are wrapped about the upper and lower portions of the flower pot.

34. The method for providing a decorative cover for a flower pot of claim 32 wherein each of the first sheets of material is further characterized as having an upper surface, a lower surface and bonding material disposed on at least a portion of the upper surface such that, upon wrapping the first sheets of material about the upper portion of the flower pot, at least a portion of the decorative cover formed about the upper portion of the flower pot by the first sheets of material is bondingly connected to the flower pot.

35. The method for providing a decorative cover for a flower pot of claim 31 wherein the second sheet of material is characterized as having an upper surface, a lower surface and bonding material disposed on at least a portion of the upper surface such that, upon wrapping the second sheet of material about the lower portion of the flower pot, at least a portion of the decorative cover formed about the lower portion of the flower pot by the second sheet of material is bondingly connected to the flower pot.

36. The method for providing a decorative cover for a flower pot of claim 35 wherein the first and second sheets of material are each constructed of a flexible material selected from the group consisting of paper, metal foil, natural polymer films, synthetic polymer films, cling wrap, cloth, burlap and combinations thereof.

37. The method for providing a decorative cover for a flower pot of claim 36 wherein the first and second sheets of material each have a thickness in a range of from about 0.1 mil to about 30 mils.

* * * * *